United States Patent [19]

Kobayashi et al.

[11] Patent Number: 4,517,771

[45] Date of Patent: May 21, 1985

[54] ELONGATED ANNULAR VIBRATORY BARREL FINISHING APPARATUS HAVING UNBALANCED WEIGHTS CONTROLLED BY AN ELECTRONIC PROCESSOR

[75] Inventors: Hisamine Kobayashi; Tomihiro Ishiguro; Akio Murata, all of Nagoya, Japan

[73] Assignee: Shikishima Tipton Manufacturing Co., Ltd., Nagoya, Japan

[21] Appl. No.: 447,007

[22] Filed: Dec. 6, 1982

[30] Foreign Application Priority Data

Dec. 10, 1981 [JP] Japan ..... 56-199034
Apr. 5, 1982 [JP] Japan ..... 57-56327

[51] Int. Cl.[3] ..... B24B 31/00
[52] U.S. Cl. ..... 51/163.2
[58] Field of Search ..... 51/163.1, 163.2, 164 R

[56] References Cited

U.S. PATENT DOCUMENTS

| | | | |
|---|---|---|---|
| 3,606,702 | 9/1971 | Balz | 51/163.2 |
| 3,694,968 | 10/1972 | Isaacson | 51/163.1 |
| 3,877,178 | 4/1975 | Campanelli | 51/163.2 |
| 4,195,447 | 4/1980 | Walther | 51/163.2 |
| 4,317,313 | 3/1982 | Kobayashi | 51/163.2 |

FOREIGN PATENT DOCUMENTS

| | | | |
|---|---|---|---|
| 375166 | 5/1973 | U.S.S.R. | 51/163.1 |
| 743849 | 6/1980 | U.S.S.R. | 51/163.1 |

*Primary Examiner*—Harold D. Whitehead
*Attorney, Agent, or Firm*—Wenderoth, Lind & Ponack

[57] ABSTRACT

A workpiece handling machine having an annular barrel structure capable of vibration caused by a plurality of vibration suppliers equipped with unbalancing weights includes a sensor system which is sensitive to any difference between the reference rotational angular phase of one unbalancing weight and those of the other unbalancing weights, and a control system which is responsive to the detected signals of the sensor system for providing an analog or digital feedback control, which adjusts the phase difference to the target value. As such, not only is the synchronized phase of rotation permitted, but also the advance angle of the unbalancing weights with regard to each other can be chosen, depending upon the operational requirements such as the kind of the workpiece and abrasive media, the workpiece working conditions, the time period of the operation, and other parameters.

10 Claims, 12 Drawing Figures

ELONGATED ANNULAR VIBRATORY BARREL FINISHING APPARATUS HAVING UNBALANCED WEIGHTS CONTROLLED BY AN ELECTRONIC PROCESSOR

BACKGROUND OF THE INVENTION

1. Field of the Invention

The present invention relates to a vibratory barrel finishing apparatus, and more particularly, to an elongated annular vibratory barrel type finishing apparatus for line-processing. In order to obtain a smooth spiral and circulating flow of the mass, it is necessary to install a plurality of pair of unbalancing weights, fixed on both ends of each motor shaft, in which the phase of rotation of the motors is synchronized. Furthermore, it is necessary, not only to synchronize the phase of rotation of both motors, but also to change the advance angle of the unbalancing weights on both ends of each shaft for accommodating the condition of the mass (kinds and charging ratio of workpieces or media, kinds of compounds etc.), objectives of working (rough finish or fine finish) and time necessary for a circulation. It is a major object of the present invention to provide an apparatus, wherein the advance angle of the unbalanced weights on both ends of each shaft is made to be variable and/or that the rotating phases of the unbalancing weights are synchronized, both effects being performed by an electronic processor.

2. Description of the Prior Art

An elongated annular vibratory barrel finishing apparatus are disclosed by the same inventor in U.S. Pat. No. 4,317,313, in which a long travel vibratory barrel having a length of 5 to 15 times the width is vibrated by a motor, by a plurality of motors, or by a plurality of unbalanced weights connected by synchronizing belts. However, these apparatus have disadvantages in that the mode of mass flowing is not always satisfactory using a motor in that the phase of rotation of the unbalanced weight is not synchronized by using a plurality of motors without is synchronizing mechanism and that noise produced and the high strength required of the belts are troublesome when the unbalanced weights are synchronized by belts.

SUMMARY OF THE INVENTION

It is, therefore, a major object of the invention to overcome the above-described problems of the prior art.

To this end, according to the present invention, an elongated annular vibratory finishing apparatus is constituted by two or more paralled straight barrel segments and arculate barrel segments which connect the straight segments at their ends, the straight sections providing the desired length of the finishing line and the arcuate end sections permitting the circulation of the mass, springs by which the annular barrel is mounted on a base of free vibration, and a plurality of vibrating motors disposed symmetrically along the longer axis of the annular barrel, each of said vibratory motors having a vertical rotary shaft and having unbalancing weights on the upper and lower ends of said rotary shaft at a predetermined angle to each other with respect to the axis of the shaft for producing a predetermined vibrating force during rotation of said shaft, said vibrating motors connected to a variable frequency inverter controlled by an electronic processor for synchronizing the rotating phase of the unbalancing weights with digital or analogue display of the rotational speed and the phase difference of rotation of the shafts.

If necessary, the advance angle of the unbalancing weights on the ends of the shaft can be made to be variable the same processor or another processor in order to accommodate the condition of the mass, objectives of working and the time necessary for a circulation.

BRIEF DESCRIPTION OF THE DRAWINGS

The above and other objects, as well as advantageous features of the invention will become clear from the following description of the preferred embodiments taken in conjunction with the accompanying drawings, in which.

DESCRIPTION OF THE PREFERRED EMBODIMENTS

Various preferred embodiment of the invention will be described hereinunder with reference to the accompanying drawings.

Figure 1:
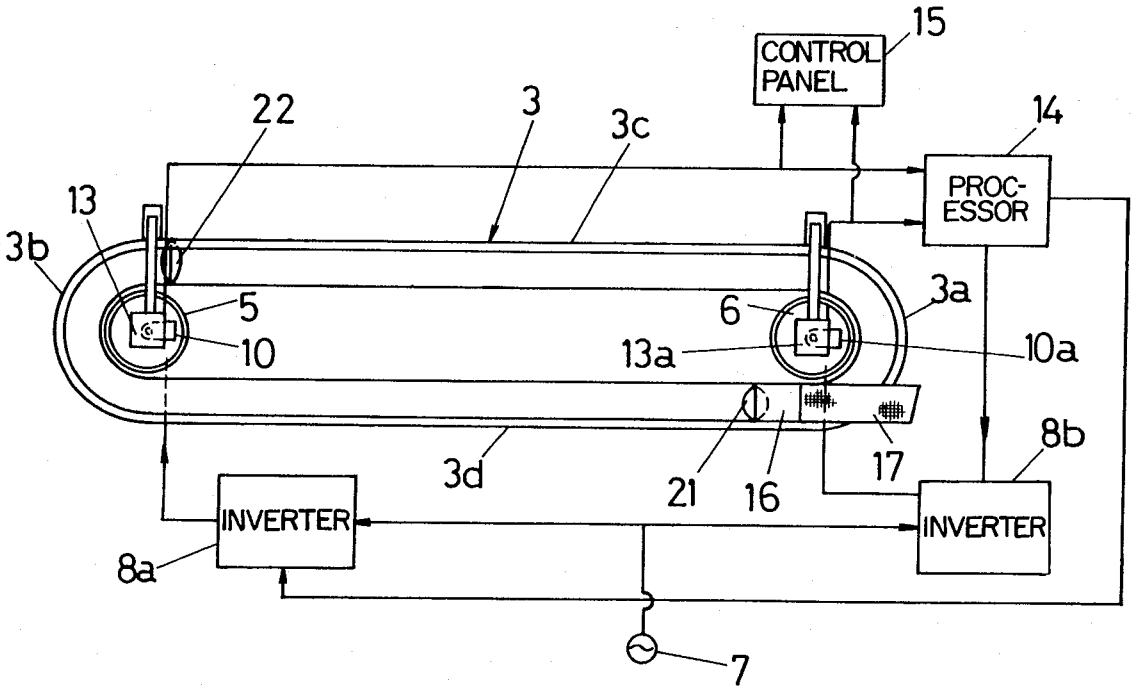
FIG. 1 is a plan view of an elongated annular vibratory finishing apparatus which is an embodiment of the invention.
Figure 2:
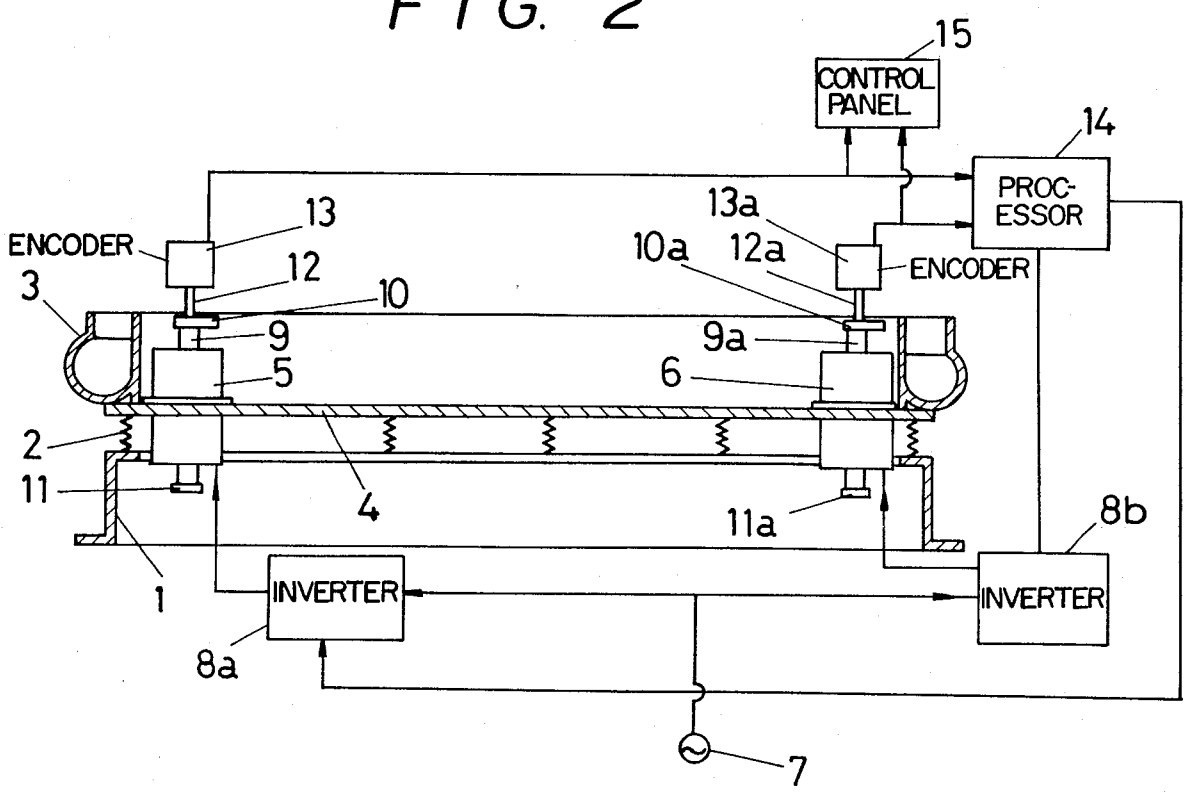
FIG. 2 is an elevational view of the apparatus in FIG. 1, partly indicating the section.

The embodiment shown in FIGS. 1 and 2 is the instance in which two electric motors are phase-controlled to provide a synchronized rotation with respect to one another. It should be noted, however, that this embodiment may be varied so that more than two motors are included. Now, the construction is described in particular reference to FIGS. 1 and 2, in which a barrel 3 having an annular shape mass travel has a plate 4 at the bottom covering the central space defined by the annular travel of the barrel 3, the bottom plate 4 carrying a motor 5 on one side and a motor 6 on the other side. Both the motors 5 and 6 are mounted upright with the motor shafts extending vertically. For those motors, relatively low-cost motors, such as three-phase induction motors, can be employed. Each of the motors has a pair of unbalancing weights 10, 10*a*, 11, 11*a*. The action of the unbalancing weights is as follows. When the main shaft is driven for rotation, a centrifugal force is produced and is imparted to the barrel 3 which contains a mass (which is a mixture of work pieces to be surface-finished, abrasive media and compound solution) so that it is placed under vibration. The vibratory motion of the barrel 3 causes a toroidal flow of the mass through the annular travel of the barrel 3, that is, the mass is traveling both in a spiral motion around the substantially round cross section of the mass passage of the barrel 3 and in a circulating motion in an axial direction of the barrel travel. This toroidal motion of the mass through the entire travel of the barrel 3 produces the surface-finished workpieces. In this case, the lead or advance angles between the unbalancing weights for two motors are chosen to provide the most appropriate toroidal motion of the mass. For the barrel construction shown in FIGS. 1 and 2, for example, the advance angle of one weight with respect to the other weight has the range of 90° and 180°, preferably 120° and 150°, which is kept constant during the operation of the surface-finishing process. For the barrel construction later to be described, for example, this advance angle is variably controlled by an electronic processor so that it can provide the most appropriate advance angle during the operation. The barrel structure 3 is disposed on a machine pedestal 1 below such that the barrel 3 is vibratably supported by a pluralily of springs 2, 2 mounted between the barrel and pedestal. The barrel 3 includes two parallel barrel sections 3*c* and 3*d* running in a longitudinal direction and two semicircle barrel sections 3*a* and 3*d* traversing the barrel sections 3*c* and 3*d* on the opposite ends thereof, those barrel sections being connected to constitute an annular barrel. The aforementioned motor 5 is electrically connected via a variable frequency inverter 8*a* to a commercial frequency power supply 7. The aforementioned motor 6 is connected to a variable frequency inverter 8*b*, which supplies a variable frequency to drive the motor for rotation with angular velocities controlled by the inverter 8*b*. The rotary shaft 9 of the motor 5 has a pair of unbalancing weights 10 and 11 respectively mounted on the upper and lower ends thereof, and the rotary shaft 9*a* of the subsidiary motor 6 has a pair of unbalancing weights 10*a* and 11*a* respectively mounted on the upper and lower ends thereof. The rotational speed of both motors are the same in stationary working, when the advance angle of both unbalancing weights is set for predetermined value. When the advance angle is not the predetermined value, the controlling system works and changes the rotational speed of one of the motors until tne predetermined advance angle is attained. The rotational speed of both motors in stationary working is also adjusted at the optimum value, selected by the previous experiments.

Figure 3:
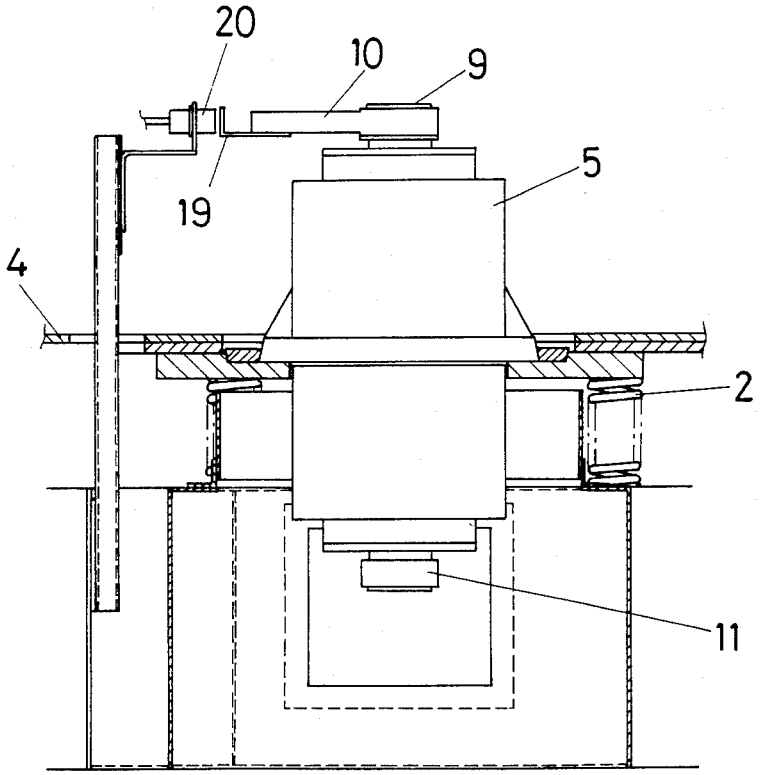
FIG. 3 is a front view of a varied form of the embodiment including the signal generator system that responds to micro-switches.

Signal generators or encoders 13 and 13*a*, which are per se known and are located on the pedestal 1, are connected by means of respective flexible cables 12 and 12*a* to each of the rotary shafts 9 and 9*a*. Thus, the signal generators 13 and 13*a* detect the actual rotational speed the phase of the rotary shafts. The output of each of the signal generators 13 and 13*a* is connected to a processor 14, which is connected to the variable frequency inverters 8*a* and 8*b*. FIG. 3 is a varied form of the signal generator, in which a dog 19 is provided at the tip (or above) of the upper weight 10 (which may be the lower weight), and a micro switch (magnetic sensor) 20 is provided at the proximity of the dog 19 opposite it and is magnetically sensitive to the unbalancing weight passing by it. In FIGS. 1 and 2, reference numeral 15 designates a control panel which contains control knobs for adjusting the speed of rotation of the motor 5 and the advance angle of the motor 6 with respect to the motor 5, respectively, and an analog or digital indicator. When a constant rotational speed by an ordinary frequency is preferable, one of the variable frequency inverters 8*a* or 8*b* is unnecessary. In this case, one of the motors 5 or 6 is rotated with a constant rotational speed by the ordinary frequency and the rotational speed of the other motor is controlled.

Figure 4:
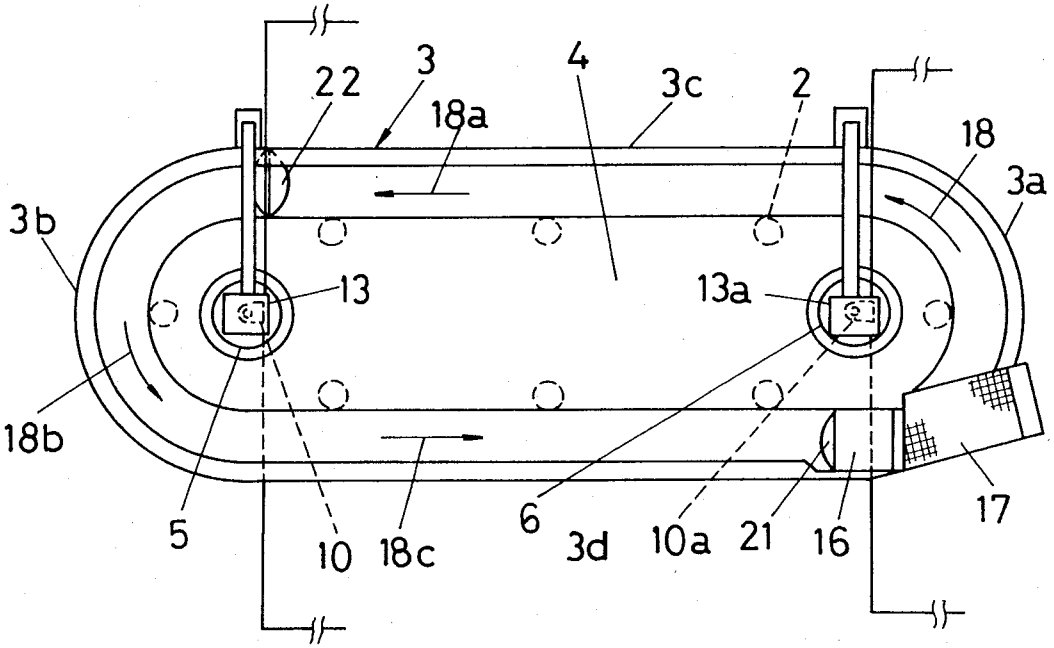
FIG. 4 is a plan view of another embodiment of the invention in which a barrel structure having an inclined travel is provided.
Figure 5:
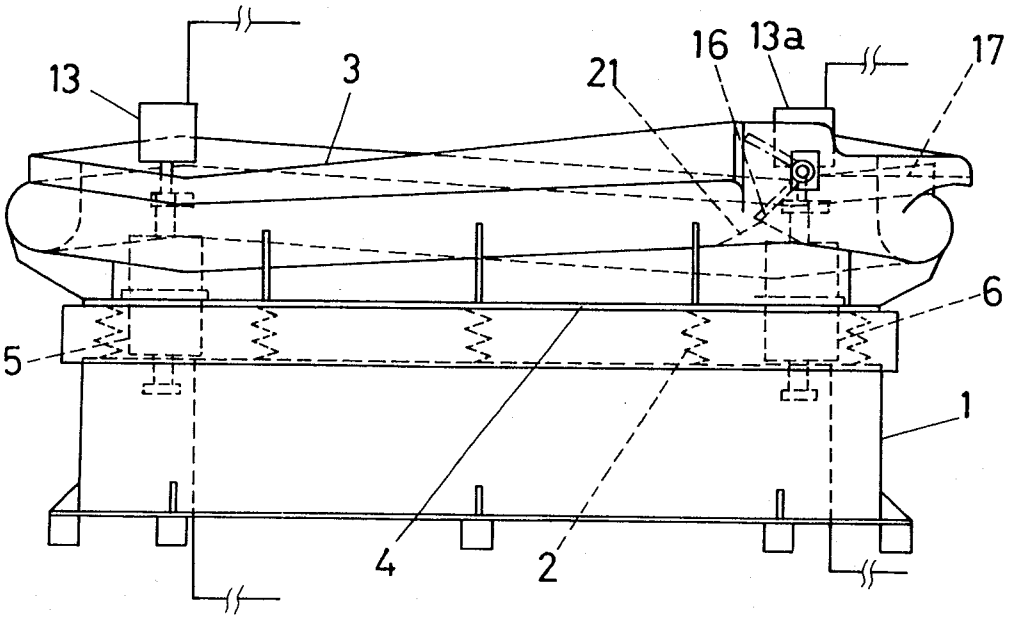
FIG. 5 is a front view of FIG. 4.

FIGS. 4 and 5 illustrate another embodiment of the invention which includes a variation of the barrel structure. As shown, the semi-circle barrel sections 3*a* and 3*b* each have a descending slope in the direction of the mass flow (as indicated by arrows 18 and 18*b*), and the two parallel straight barrel sections 3*c* and 3*d* each have an ascending slope in the direction of the mass flow (as indicated by arrows 18*a* and 18*c*), the semi-circle sections 3*a* and 3*b* and the straight sections 3*c* and 3*d* being connected at their respective butting ends to form an internal passage to allow the mass to travel smoothly. Other structural elements including the signal generators, processor, variable frequency inverters, etc. are all the same as those in the previous embodiment. In FIGS. 4 and 5, this barrel construction provides an improved mass flow particularly around the barrel corners, thus enhancing the mass separation (which is the operation for separating the mass into the finished workpieces and the abrasive media).

Figure 6:
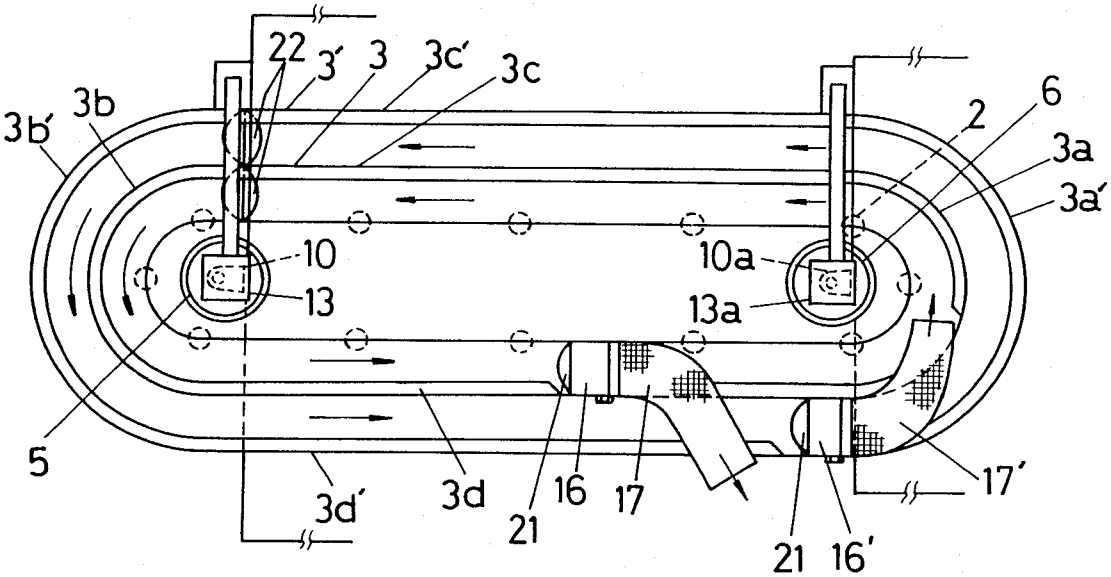
FIG. 6 is a plan view of another embodiment of the invention in which a dual-barrel structure is provided.

FIG. 6 is a varied form of the embodiment shown in FIGS. 1 and 2, in which one additional barrel 3' of analogous shape surrounds the outside of the barrel structure 3, forming a dual barrel structure including inner and outer barrels. A single machine with this dual barrel construction can provide two different finishing operations simultaneously. For example, the outer barrel 3' can be used for the rough finishing operation while the inner barrel 3 can be used for the final finishing or gloss polishing operation. Another example of the dual barrel usage is that the outer barrel 3' is used for the finishing operation while the inner barrel 3, which contains a desiccant such as sawdust, corncobs, etc., is used for the drying operations. A multiple-barrel structure consisting of more than two analogous shape barrels may be built, and as such can provide more different concurrent operations.

Figure 7:
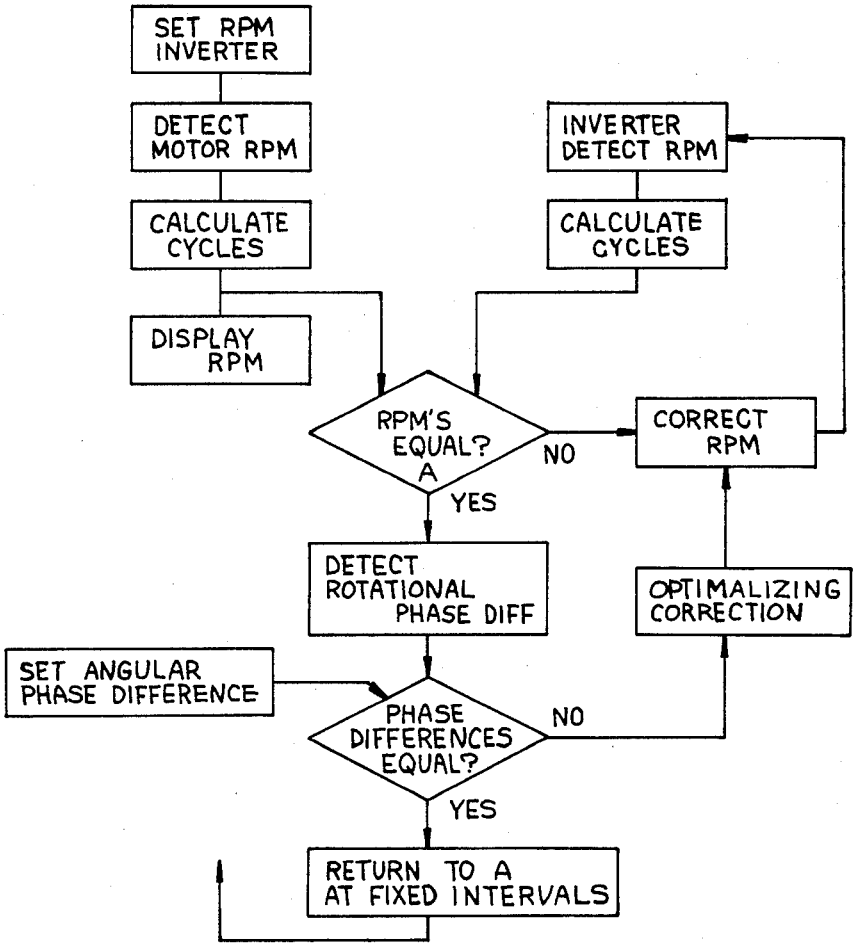
FIG. 7 is a flow chart illustrating the sequence of the operation which is applicable to the invention.
Figure 8:
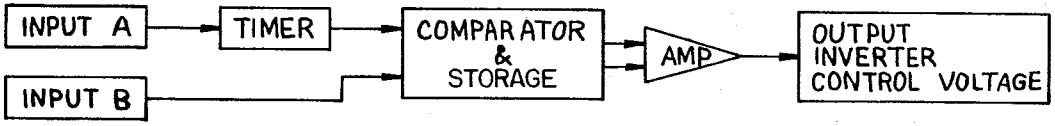
FIG. 8 is a schematic block diagram of a system that provides an analog output representation.
Figure 9:
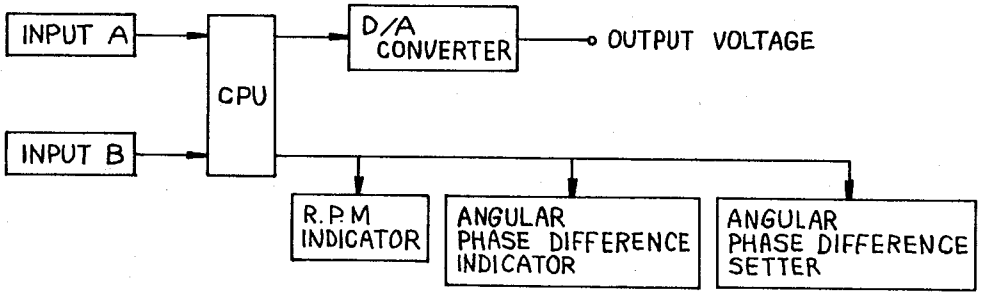
FIG. 9 is a schematic block diagram of a system that provides a digital output representation.

Next, the following is a description of an electronic circuit for controlling the rotational speed of the motor 5 and the lead angles between the unbalancing weights mounted on a plurality of motors. This electronic circuit assumes that the rotational speed of one motor and the rotating phase of the unbalancing weights on that motor are given as reference values, and controls the rotating phases of the unbalancing weights on the other motors so that they provide advance angles as specified with respect to the above reference values. The rotational speed and the advance angle are selectively set by means of a dial (e.g.—a potentiometer)to any desired value, depending upon the type of the barrel construction (such as a single barrel or multiple barrel structure), the workpiece finishing conditions and the type of the mass, and the output information is presented in the form of an analog or digital data. Also, the adaptive control may be provided by using an appropriate sensor system so that those values can be controlled to reflect the optimal operating conditions. The flow that of the control is illustrated in FIG. 7. FIG. 8 illustrates the block diagram of a system for the analog control in which inputs A and B represent input from signal generators 13, 13*a* or micro switches 20, and the timer is used to adjust the changes in the input advance angle. FIG. 9 illustrates a block diagram of a system for a digital control in which CPU represents a processor that contains the programmed computer functions.

The operation of the apparatus whose construction has been described is now described. In FIGS. 1 to 6, initially the barrel 3 contains a mass which includes abrasive media and workpieces to be surface-finished, and of necessity water and compounds, the charging of the mass into the barrel 3 being done manually or automatically. The motor 5 and motor 6 are then turned on. The motor 5 is rotated at a rotational speed which is variably controlled by the variable frequency inverter 8*a*, and the motor 6 is rotated at the same rotational speed as the motor 5 under the control of the variable frequency inverter 8*b*. The signal generators 13 and 13*a* supply output signals, which are fed into the processor (CPU) 14. The output signals of the signal generators 13 and 13*a* represent the actual angular positions of the rotary shafts of the motors 5 and 6. In response to the above signals, the processor 14 calculates any difference in the actual rotational speed and rotating angular phase of the motor 6 with respect to the reference rotational speed and rotating angular phase of the motor 5. Based on the result of the calculation, the processor 14 sends an instruction to the variable frequency inverter 8*b* so that both the motors can be rotated with the same rotational speed and with the specified advance angle with respect to each other. That is, the variable frequency inverter 8*b* responds to the instruction from the processor 14 so that the variable frequency inverter 8*b* modifies the frequency to one commanded by the processor 14 so as to permit the motor 6 to rotate at the same rotational speed and with virtually the same rotating phase or with preselected differences in rotating phase as the main motor 5. The synchronized rotation and phase can thus be maintained by the constant feedback loop between the sensor system, variable frequency inverter 8*b* and processor 14. As such, the mass within the barrel 3 is travelling with the regulated toroidal motion, during which the workpieces are being surface-finished as described. At the end of the travel, the mass is moving up a stationary mount dam 21 and then beyond it onto a movable flap 16 (which is now closed in this case). From the flap 16, the mass is then introduced onto a mass separating sieve 17 where the mass is separated into the abrasive media and workpieces. The abrasive media may be returned for reuse, and the workpieces are moved out of the surface-finishing environment for other treatment processes if necessary. This has been described for the inline processing operation. For the purpose of the batch processing operation, the movable flap 16 is raised to allow the mass to recirculate within the barrels 3 and/or 3'. As designated by reference numeral 22, a mass flow regulating dam is provided for permitting the mass to travel around the corner with a uniform flow and without being detered at any particular point of the corner. This dam may be omitted for the purpose of the present invention. The above described embodiment applies to the control of the two motors, i.e., one main motor and one subsidiary motor. The present invention may also be applied to controlling more than two motors. In this case, each of the subsidiary motors requires one variable frequency inverter and one signal generator system, but those variable frequency invertor and signal generator systems which are connected to the corresponding subsidiary motors can be controlled by one processor (CPU). It should be noted, however, that when the unbalancing weights for those motors are of equal magnitude (weight and size), the increasing speed of the motors causes their respective unbalancing weights to produce the correspondingly, increasing vibrating force, which makes it possible to increase the quantity of workpieces to be processed. At the same time, this tends to produce roughly finished surfaces of the workpieces. Therefore, the appropriate rotational speed for those motors should be determined, depending upon the type of the barrel construction (single, double, or multiple), the kind of the workpieces including the abrasive media to be used, and the condition of the unbalancing weights. The advance angle between the unbalancing weights of the main and subsidiary motors is normally set to zero degree, but may be set to any other appropriate value depending upon the flow condition of the mass. For example, if the unbalancing weight located below one region of the barrel has its advance angle ahead of the remaining unbalancing weights located under the other regions, the part of the mass in that region is traveling with an increased amplitude and can thus flow more smoothly. In this case, the advance angle can be modified depending upon the actual flow condition of the mass in the different regions of the barrel. The proper flow of the mass can be achieved in this manner. This advance angle is typically set to any value within the range of sixty degrees. In the foregoing description, it has been assumed that the apparatus is used for the workpiece surface finishing operation. The applications of the above described embodiment of the invention may include the stirring, mixing, milling, and other operations. All those applications should be understood to fall within the scope of the present invention.

The following provides a description of the construction of the vibration generating system in which the advance angle between the unbalancing weights in a vibrating source is to be modified as required. In the constructions shown in FIGS. 1 thru 9, each motor has a pair of unbalancing weights secured to the opposite ends of the rotary shaft. In those cases, modification is often required to the relative angle between the unbalancing weights for those motors. During the actual operations, the modification to this advance angle is required whenever it becomes necessary to change the operating conditions such as the condition of the mass (kinds and charging ratio of workpieces or media, kinds of compounds, etc.), objectives of working (rough finish or fine finish), and time intervals required for allowing for the mass circulation. For the vibration generating system which permit two or more axially aligned unbalancing weights to rotate and produce a vibration force, for example, there are several conventional methods of varying the mode of the vibration supplied by the unbalancing weights. Generally, those methods provide unbalancing weights of different sizes and weights which are to be used depending upon the above-mentioned operating conditions, or alternatively provide means of varying the relative advance angles between the unbalancing weights. Specifically, those methods include a method of using the individual unbalancing weights to be interchangeable as required, a method of giving a loose connection between the rotary shaft and unbalancing weights and varying the point of contact between the two elements depending on the sense of direction of the rotation, a method of changing the relative position between the rotary shaft and unbalancing weights by external mechanical means, and a method of using an unbalancing weight equipped with a movable part and causing the movable part to be moved by external mechanical means. Any of those conventional methods has its own disadvantage. For the first method of physically changing the unbalancing weights, lots of time and labor are required since it involves the need of stopping the machine and replacing the existing unbalancing weights with new ones. For all of the other methods, the complicate mechanisms must be required to implement the methods, and in most cases, the range of the variable advance angle and the range of moment provided by the unbalancing weights are limited. Furthermore, multi-level control is provided in most of those methods, so that it is practically impossible to provide a wide range of mode of vibration.

The present invention solves the disadvantages of the prior art methods by providing sensor means that is responsive to the actual relative position of each of the unbalancing weights mounted to the general-purpose motor shafts and delivers a pulse signal as input to the processor 14. Another processor may be attached in addition to the processor 14, if it cannot afford to handle the pulse signal from the sensor system. The actual relative position which is at every instant detected by the sensor system and is found to deviate from its proper position is then corrected to match the proper position as instructed by the processor. To do this, the variable frequency inverter with its input connected to the external commercial power supply and with its output connected to the corresponding motor is controlled by the processor so that the variable frequency inverter can provide a corrected frequency to cause the motor to rotate with the rotational speed as regulated. As clearly seen from the preceding description, the present invention provides a simple, robust and less costly construction which permits control of a wide-range advance angle of the unbalancing weights as well as wide-range moment provided by the unbalancing weight.

Figure 10:
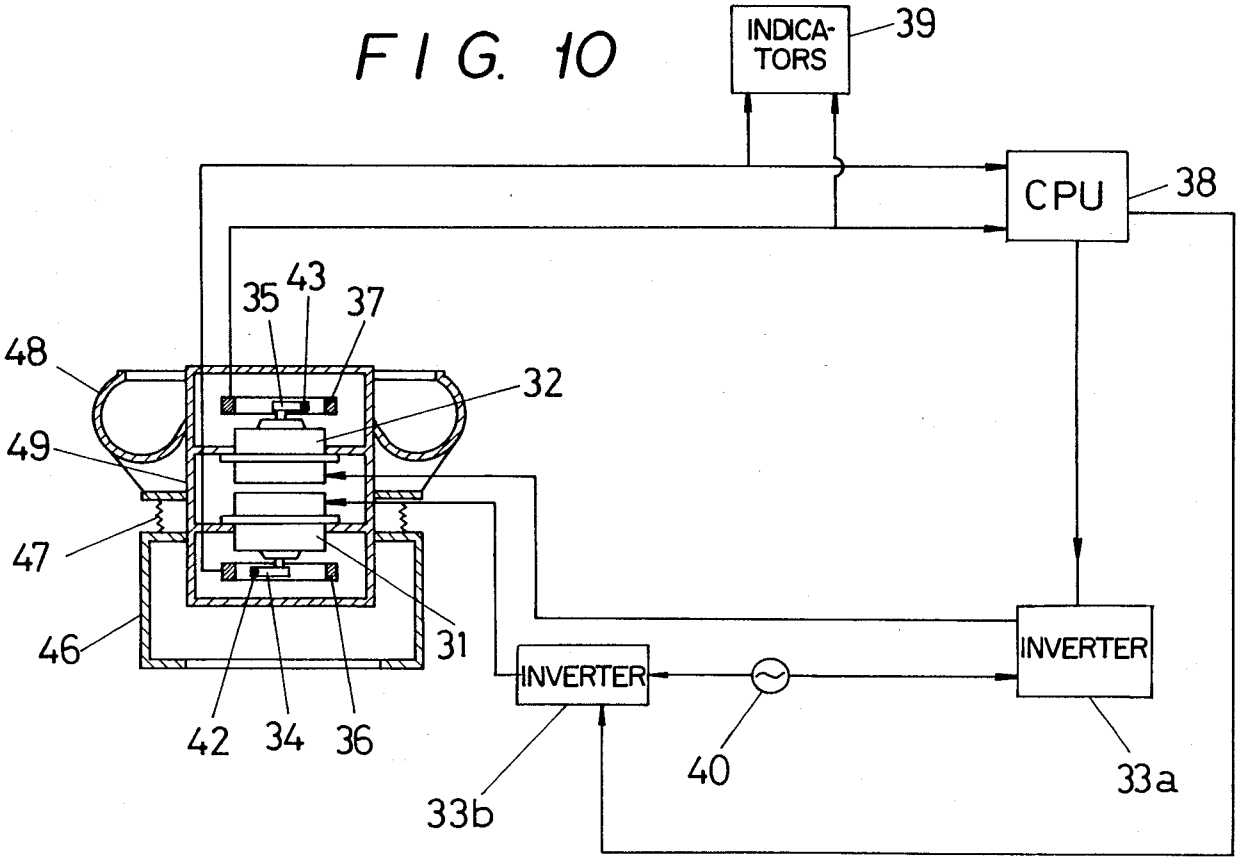
FIG. 10 is a schematic drawing of another system for variable advance angle of the unbalancing weights in applying to the present invention.

FIG. 10 is a schematic diagram illustrating how the advance angles are to be modified in aforementioned embodiment of the present invention. In FIG. 10, multiple springs 47 are mounted on a machine pedestal 46, and an annular barrel structure 48 with a central casing 49 between the parallel mass paths of the barrel 48 is vibratably supported by the springs 47. The central casing 49 contains one or more vibrating units, and each unit has two motors 31 and 32 which are rigidly mounted in position with their respective vertical rotary shafts aligned. Both motors are respectively connected through variable frequency inverters 33*a* and 33*b* to the external power supply 40, and are controlled by the variable frequency inverters so that the motors 31 and 32 can be rotated with a rotational angular velocity which corresponds to the command from the CPU 38. The motor 31 has an unbalancing weight 34 secured to one end of its rotary shaft, and the other motor 32 has an unbalancing weight 35 secured to one end of its rotary shaft. The unbalancing weight 34 has a dog 42 at one end thereof and is enclosed by a cased pulse generator assembly 36, and the unbalancing weight 35 has a dog 43 at one end thereof and is enclosed by a cased pulse generator assembly 37. Both pulse generator assemblies 36 ahd 37 are rigidly fixed to the barrel structure 48, and may be replaced by sensors which are responsive to the angular positions of the respective unbalancing weights. The pulse generator assemblies include a plurality of individual pulse generators located at regular angular positions around the unbalancing weights. As such, each of pulse generators responds to each corresponding angular position of the unbalancing weight. When a given pulse generator delivers a pulse signal in response to the dog 42 or 43 of the unbalancing weight which has rotated to the position of that pulse generator, the pulse signal is fed into a processor (CPU) 38. The processor 38 can thus detect the relative rotational position of the unbalancing weights 34 or 35 on the motors 31 or 32. The output of the processor 38 is connected to the variable frequency inverters 33*a* and 33*b*. The processor 38 provides the appropriately programmed computer functions, and determines the actual advance of the rotational angle of the unbalancing weight 35 with respect to the reference rotational angular position of the unbalancing weight 34. If the actual advance angle is found to deviate from the previously stored reference angular position or the appropriate value obtained as a result of the processor computing, the processor sends an instruction to the variable frequency inverter 33*a* so that the inverter 33*a* can provide a correct frequency output to cause the motor 32 to change its rotational speed. Once the motor 32 controlled by the variable frequency inverter 33*a* has reached the rotational speed as instructed by the processor 38 and the resulting advance angle has been obtained, the motor 32 which is now supplied with a modified frequency from the variable frequency inverter then rotates with a rotational speed which coincides with the motor 31. This is done in a feedback loop connecting between the motors and the processor with the intervening variable frequency inverters. The advance angle is thus at all times maintained constant. Indicators generally designated by 39 provide an analog or digital presentation of various data, the rotational speed of the motors and the advance angle which are changing from time to time. The use of the above described system particularly shown in FIG. 10 permits a setting of the advance angle to any desired value, and is also applied for the multi-purpose operations.

Figure 11:
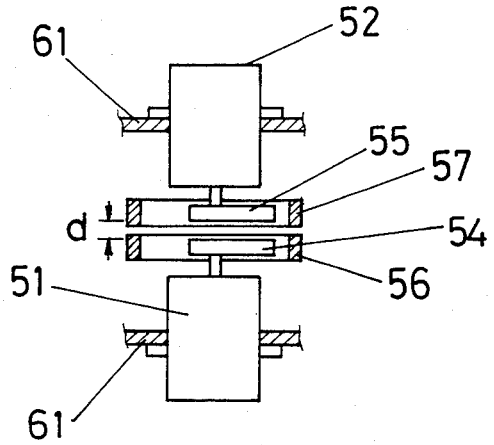
FIG. 11 is a mechanism for variable centrifugal force of the unbalancing weights.
Figure 12:
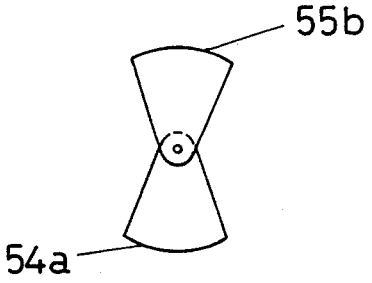
FIG. 12 is an explanatory drawing for variable centrifugal force.

FIG. 11 illustrates another preferred embodiment of the invention, which is specifically designed to permit a modification of the resultant moment provided by the unbalancing weights. In the embodiment shown in FIG. 11, two motors 51 and 52 are mounted upright with their respective rotary shafts aligned axially, each shaft carrying an unbalancing weight 54, 55 rigidly secured to one end thereof, such that the unbalancing weight 54 and 55 face each other. Like the embodiment shown in FIG. 10, the unbalancing weights are surrounded by pulse generator units 56 and 57, respectively. The vibration generating system produces a vibrating force to the barrel 61. The advance angle control for the unbalancing weights in FIG. 11 is the same as in FIG. 10, so its description is omitted here. When the two unbalancing weights 54 and 55 are placed with a rotational angular phase difference of 180° relative to each other as shown in FIG. 12, the centrifugal forces exerted upon the two unbalancing weights cancel each other (which means that while a moment is produced as a result of a distance of d which places the two unbalancing weight apart, the sum of the vectors representing the centrifugal forces results in a zero value). When there is no rotational angular phase difference between the unbalancing weights, the resulting centrifugal force doubles that of the single weight. As such, it is possible successively to have the centrifugal force ranging from zero to a value equal to double that of the single weight by varying the rotational angular phase difference between the two weights in the range of from 0° to 180°. For the convenience of the description, FIG. 11 shows that the unbalancing weights are arranged close to each other, but they may be placed further away from each other. In this case, the distance d is increased, and the moment is increased accordingly. The embodiment shown in FIG. 11 includes two motors, but the number of motors is optional. When two or more motors are used, the motors need not be arranged with their respective shafts aligned axially, and the sense of direction of rotation may be different for each of the motors.

The various embodiments of the present invention have fully been described. The machine having the long travel barrel structure according to th present invention provides the maximum throughput or finishing power. This can be achieved by allowing the unbalancing weights on the several motor shafts below the barrel to be rotated with the appropriate rotational speed as specified by the computer processor and controlling the advance angles between the unbalancing weights to be adjusted at every instant to the appropriate values as also specified by the processor. Other advantages of the machine according to the invention include the possibilities for the inline workpiece finishing process and for the trouble-free and safety operations.

Although the invention has been described by showing the various embodiments thereof with reference to the drawings, it should be understood that various modifications and changes may be made within the scope and spirit of the invention.

What is claimed is:

1. An endless elongated annular vibratory barrel finishing apparatus for line processing of workpieces to be finished, said vibratory finishing apparatus comprising:

an endless elongated vibratory barrel having two opposed semicircular barrel outer and inner wall segments and straight barrel outer and inner wall segments extending therebetween to form the elongated barrel, said barrel having a cross-section traverse to the length thereof which is symmetrical about the center of the cross-section and having two U-shaped portions between the inner and outer walls, a plurality of springs supporting the bottom of said vibratory barrel and extending along the bottom of the barrel in a line generally parallel to the axis of the U-shaped cross-sectional portions, a plurality of vibrating motors, disposed symmetrically on the longitudinal axis, each having unbalancing weights at both ends of their shafts, and a controlling means for electrically adjusting a rotational speed of the motors and the phase of rotation between said vibrating motors.

2. An apparatus as claimed in claim 1 in which, the semicircular barrel has a descending slope along the mass circulating path and the straight barrel has an ascending slope along the mass circulating path.

3. An apparatus as claimed in claim 1, in which, the controlling means are composed of sensors for sensing the positions of the unbalancing weights, variable frequency inverters connected to said motors for varying the electrical frequency output therefrom so as to electrically control the rotational speed of the motors and an electronic processor for detecting the signal from the sensors and for controlling the variable frequency inverters.

4. An apparatus as claimed in claim 3, in which, the sensors are composed of pulse generators for detecting the positions of the unbalancing weights.

5. An apparatus as claimed in claim 3, in which, the sensors are composed of proximity switches for detecting the positions of the unbalancing weights.

6. An apparatus as claimed in claim 1, in which, the rotational speed and the phase of rotation of said vibrating motors are indicated by analog or digital means and can be adjusted.

7. An apparatus as claimed in claim 1, in which said controlling means includes an electronic processor and a setting apparatus for controlling said motors such that one motor rotates at a pre-determined rotational speed and another motor is rotated by means of a variable frequency inverter at the same speed of said one motor, so as to electrically maintain a definite phase difference of rotation therebetween.

8. An apparatus as claimed in claim 1, in which, said controlling means includes a means for controlling one motor so that it is rotated by electrical power having a frequency which is equal to an ordinary line frequency and includes a variable frequency inverter for controlling another motor.

9. An apparatus as claimed in claim 1, in which, a vibrator unit is composed of two motors whose shafts are coaxial, and having unbalancing weights fixed at the ends of both shafts, and said controlling means includes a means for electrically adjusting the phase of rotation of both unbalancing weights.

10. An apparatus as claimed in claim 1, in which, each unbalancing weight is composed of two weights driven by two motors, separately, and said controlling means includes a means for electrically adjusting the phase of rotation of both weights.

* * * * *